US005300920A

United States Patent [19]

Caselli et al.

[11] Patent Number: 5,300,920

[45] Date of Patent: Apr. 5, 1994

[54] BASKETBALL GAME HAVING SCORING SLAP-PADS

[75] Inventors: Rick Caselli, Cupertino; Pat Tura; Michael Cookson, both of San Francisco; Ake Larsson, Palos Verdes Estates, all of Calif.

[73] Assignee: Mattel, Inc., El Segundo, Calif.

[21] Appl. No.: 930,573

[22] Filed: Aug. 17, 1992

[51] Int. Cl.[5] ..... G08B 23/00

[52] U.S. Cl. ..... 340/323 R; 273/1.5 A; 273/1.5 R

[58] Field of Search ..... 273/1.5 A, 1.5 R, 371, 273/374; 340/323 R, 323 B, 665, 309.15, 718; 364/410, 411, 412, 526; 434/248, 249; 377/5

[56] References Cited

U.S. PATENT DOCUMENTS

| | | | |
|---|---|---|---|
| 3,716,234 | 2/1973 | Lancellotti | 273/1.5 A |
| 4,013,292 | 3/1977 | Cohen et al. . | |
| 4,491,954 | 1/1985 | Genuit . | |
| 4,715,598 | 12/1987 | Knight | 273/1.5 R |
| 4,858,920 | 8/1989 | Best . | |
| 4,904,981 | 2/1990 | Mele et al. . | |
| 4,955,605 | 9/1990 | Goldfarb | 273/1.5 A |
| 4,956,775 | 9/1990 | Klamer et al. . | |
| 4,999,603 | 3/1991 | Mele et al. . | |
| 5,027,102 | 6/1991 | Sweeny | 364/411 |
| 5,039,977 | 8/1991 | Mele et al. . | |
| 5,066,006 | 11/1991 | Driska | 273/1.5 A |

FOREIGN PATENT DOCUMENTS 2237512 5/1991 United Kingdom ..... 273/371

*Primary Examiner*—John K. Peng
*Assistant Examiner*—Tim Johnson
*Attorney, Agent, or Firm*—Roy A. Ekstrand

[57] ABSTRACT

A basketball game includes a generally planar backboard supporting a circular hoop having a basketball net extending downwardly therefrom. A center housing is supported beneath the hoop and secured to the backboard. A pair of score indicators having digital score indicating displays are supported on either side of the backboard. A pair of slap actuated depressible slap-pads are secured to and supported by the indicator housings. A flexible score sensor is secured to the center housing and extends into the net passage. The score sensor includes a flexible joint having a flex gauge or strain gauge operative therewith to provide an electrical signal each time the ball is successfully shot by a player and passes through the hoop and basketball net. In the preferred play pattern, the player having successfully scored a basket is able to increment the player's indicated score by slapping the appropriate one of the slap-pads following the successful shot. In the absence of a successful preceding shot, the slap-pads remain ineffective and operation thereof fails to alter the displayed player's score. A multi-jointed, generally tubular support frame supports the backboard and basketball hoop at a predetermined adjustable height.

8 Claims, 4 Drawing Sheets

FIG. 5
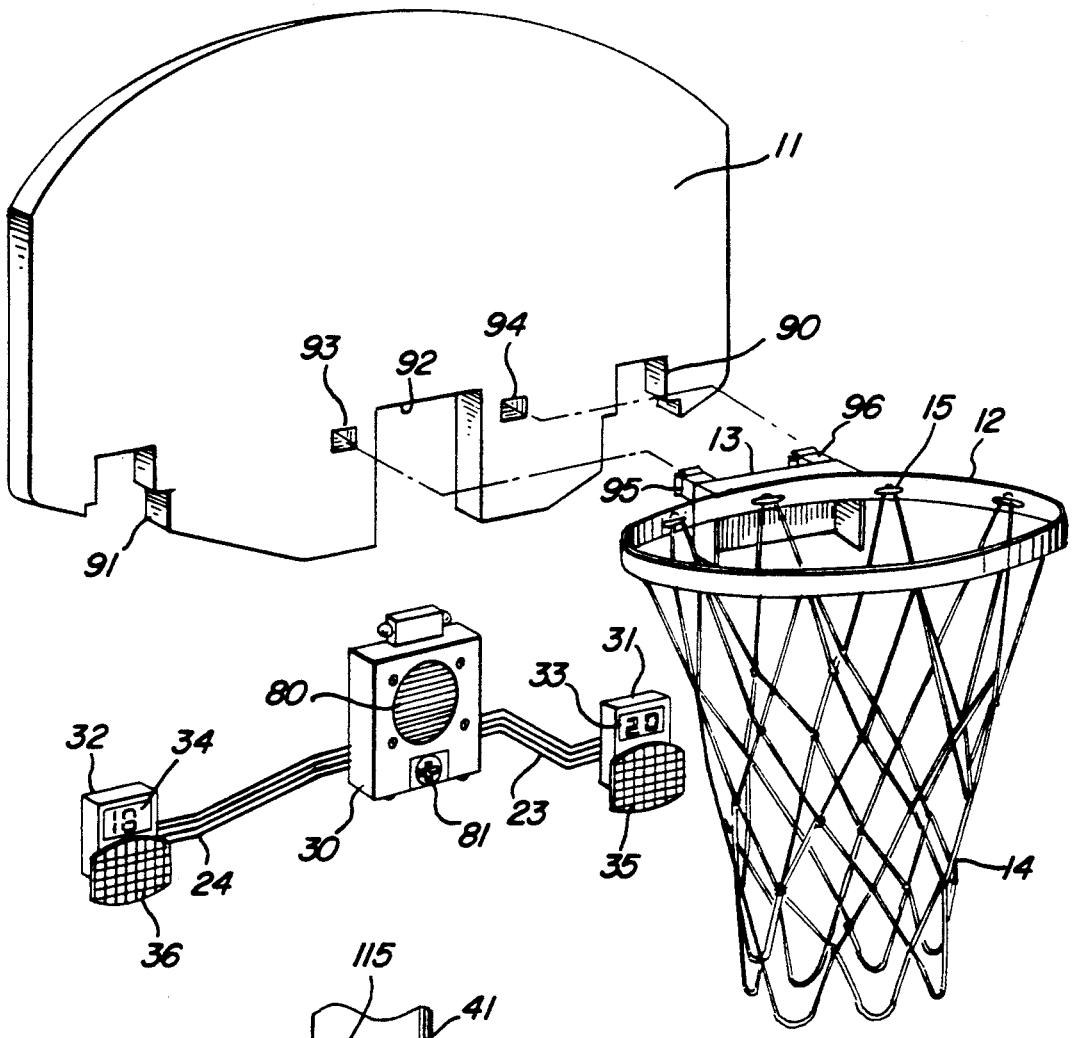
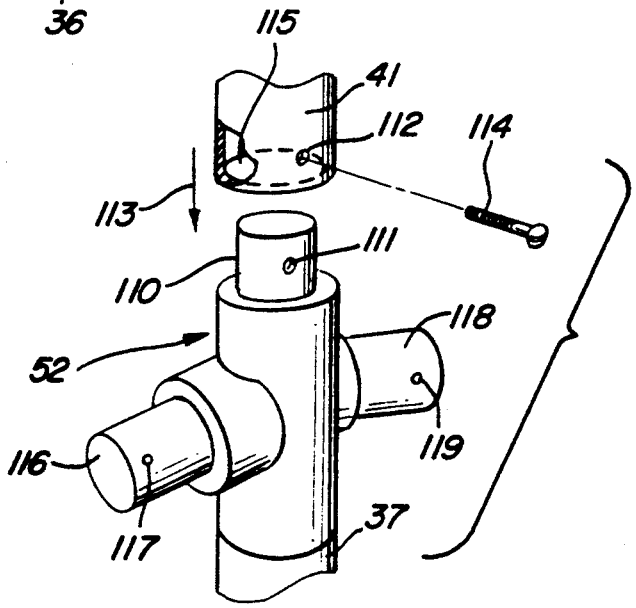
FIG. 6

BASKETBALL GAME HAVING SCORING SLAP-PADS

FIELD OF THE INVENTION

This invention relates generally to basketball games and particularly to scoring and monitoring units used therein.

BACKGROUND OF THE INVENTION

In response to the continuous and growing popularity of the sport of basketball, practitioners in the art have endeavored to provide a variety of accessories and amusement devices to further enhance game play. These accessories have included items such as scorekeeping devices, score indicating devices and apparatus used generally as game monitoring units which often include various game rule variations or the like.

For example, U.S. Pat. No. 5,039,977 issued to Mele et al sets forth a MULTIFUNCTIONAL BASKETBALL GAME MONITORING UNIT in which a support housing is positioned for attachment on or near the rear portion of a typical basketball backboard. The scoring unit is capable of sensing the spot location from which a shot is taken and adjusting the resulting score for successful shots based upon the time the shot remains airborne, the shooting location, and other selected criteria.

U.S. Pat. No. 4,999,603 issued to Mele et al sets forth a MULTIFUNCTIONAL BASKETBALL GAME MONITORING UNITS in which scoring accommodates the number of foul shots and shot positions and includes a processing unit for allowing a great variety of differing output statistics to a visual display included within the monitoring unit. A printer is coupled to the monitoring unit and provides a printed output of the player's performance statistics.

U.S. Pat. No. 4,956,775 issued to Klamer et al sets forth an OBJECT SENSOR FOR DETECTING CHARACTERISTICS SUCH AS COLOR FOR GAMES in which a basketball goal and backboard are provided with score indicating displays together with a photosensitive score sensing unit. The photosensing unit is capable of distinguishing differing characteristics between two game balls such as color to separately tabulate the individual scores of each player. A timing device is provided to establish a time interval within which scores may be accepted.

U.S Pat. No. 4,904,981 issued to Mele et al sets forth a MULTIFUNCTIONAL BASKETBALL GAME MONITORING UNIT which allows visual display and printout of total baskets made, score and percentage of total baskets made together with free through and goal shooting tabulation.

U.S. Pat. No. 4,858,920 issued to Best sets forth a SCORE SENSITIVE BASKETBALL HOOP for detecting the passage of a basketball through the basketball hoop. The sensor comprises a transmitting light and photoelectric cell receiver which produces a continuous light beam sensed by the photoelectric cell. The passage of the basketball through the hoop breaks the light beam and signals a successful score which in turn produces an audible or visual response.

U.S. Pat. No. 4,013,292 issued to Cohen et al sets forth an AUTOMATIC BASKETBALL GAME HAVING SCORING INDICATOR AND TIME LIMITATION in which a coin operated game includes a shooting station and remotely positioned basketball hoop. A timer releases a plurality of basketballs to the player and initiates a timing interval. The game further includes a score tabulation system which counts the number of successful shots during the predetermined time interval of the timer.

U.S. Pat. No. 4,491,954 issued to Genuit sets forth an ELECTRONIC SCOREKEEPER FOR TABLE TENNIS in which a ping pong table and net are provided with a score indicating apparatus and a pair of score tabulating buttons which are actuated by a successfully scoring player to increment the score.

While the foregoing described prior art devices have enhanced the enjoyment and amusement value of various basketball games or other activities, there remains nonetheless a continuing need in the art for evermore improved, exciting and amusing accessories for basketball games.

SUMMARY OF THE INVENTION

Accordingly, it is a general object of the present invention to provide an improved basketball type game. It is a more particular object of the present invention to provide an improved, more amusing scoring device for use in combination with a basketball type game.

In accordance with the present invention, there is provided a basketball game for use in combination with a ball comprises a generally planar backboard, a generally circular hoop supported by the backboard, a pair of player score indicators, a pair of slap-pads supported by the backboard, a score sensor responsive to the passage of the ball through the hoop, and control means for controlling the pair of player score indicators, the control means increasing the displayed score on a score indicator in response to the actuation of the appropriate one of the slap-pads directly following a sensed basket.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 5 sets forth a perspective assembly view of the backboard, hoop, and scoring apparatus of the present invention basketball game;

FIG. 6 sets forth a partially sectioned perspective view of a typical structural joint within the support mechanism of the present invention basketball game.

DESCRIPTION OF THE PREFERRED EMBODIMENT

Figure 1:
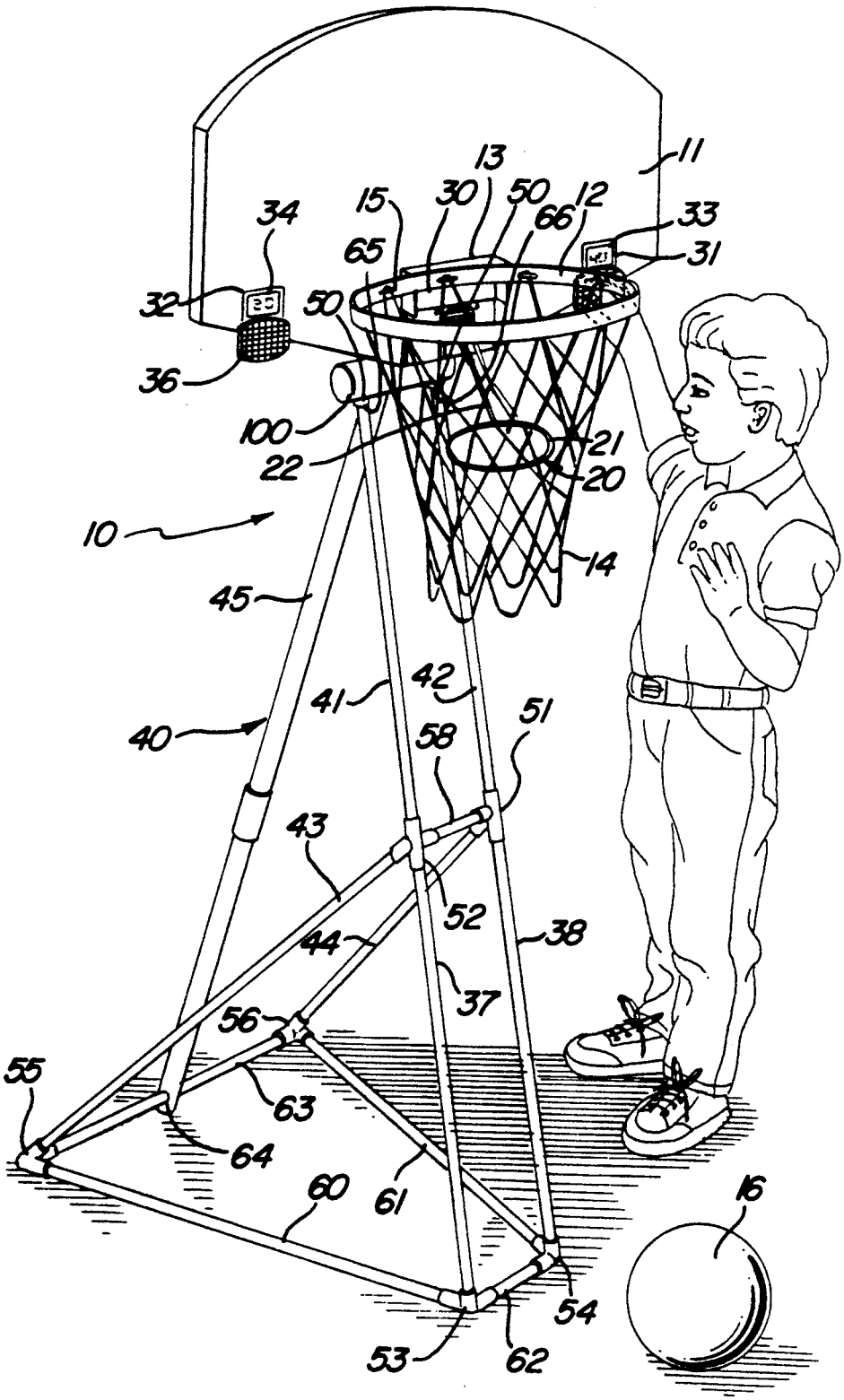
FIG. 1 sets forth a perspective view of a basketball game having scoring slap-pads constructed in accordance with the present invention.

FIG. 1 sets forth a perspective view of a basketball game having scoring slap-pads constructed in accordance with the present invention and generally referenced by numeral 10. Basketball game 10 includes a generally planar backboard having a circular basketball hoop 12 coupled to and supported by a hoop support 13. Hoop support 13 is secured to backboard 11 in the manner set forth below. Hoop 12 further includes a plurality of inwardly extending net attachments 15 which receive and support a conventional basketball net 14.

In accordance with an important aspect of the present invention, basketball game 10 further includes a housing 30 together with a pair of indicator housings 31 and 32 spaced on either side of basketball hoop 12. Indicator housings 31 and 32 further include and support a pair of digital readout score indicators 33 and 34, respectively, together with a pair of depressible slap-pads 35 and 36. A score sensor 20 includes an elongated shaft 22 secured at one end to housing 30 in the manner set forth below and terminating in a generally circular ring 21.

Figure 2:
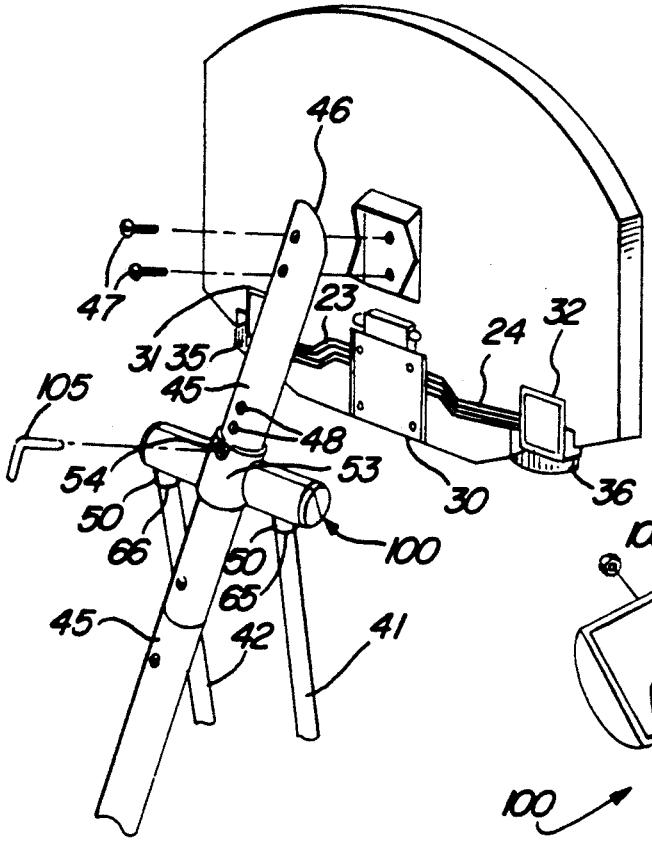
FIG. 2 sets forth a rear partial assembly view of the support structure for the goal portion of the present invention basketball game.

A support frame generally referenced by numeral 40 includes an extending angularly disposed main support 45 having an aperture 64 defined in the lower end thereof and as is better seen in FIG. 2, terminating in an angled facet 46 on the upper end thereof. The latter is secured by means set forth in FIG. 2 to an attachment which provides support for backboard 11. Support frame 40 further includes a plurality of generally tubular base elements 61, 62, 63 and 64 secured by a corresponding plurality of joints 53-56 to form a generally trapezoidal base element which rests upon the play surface. Base element 63 passes through aperture 64 at the lower end of main support 45. A pair of angled support members 37 and 38 preferably formed of a tubular material are secured to joints 53 and 54, respectively, and extend upwardly therefrom. A second pair of angled support members 43 and 4 extend upwardly and forwardly from joints 55 and 56, respectively, and are joined to support members 37 and 38 by joints 52 and 51, respectively. A cross member 58 is coupled between joints 51 and 52. An additional pair of angularly disposed support members 41 and 42 extend upwardly and rearwardly from joints 52 and 51, respectively, and are received within a pair of sockets 65 and 66, respectively, within junction elements 100. As is better seen in FIG. 2, junction 100 also receives and is coupled to main support 45. The resulting structure of support frame 40 provides substantial stability and strength in supporting backboard 11. In addition, and as is also better seen in FIG. 2, the height of backboard 11 is adjustable to accommodate children of different heights and skill levels.

In accordance with the present invention, basketball game 10 is played in combination with a ball 16 and in similar fashion to other basketball games. Thus, the child user attempts to shoot ball 16 so as to pass through hoop 12 and net 14. The passage of ball 16 through hoop 12 and net 14 is sensed by score sensor 20 as ball 16 passes through net 14 and forces sensor 20 downwardly in a motion which is utilized by sensor 20 to detect a successful shot. In accordance with the game play set forth below in greater detail a plurality of game formats may be utilized to assign predetermined values to each successful shot and to establish time limits for a interval timed shooting game. In addition, and in accordance with an important aspect of the present invention, each player is able to advance his or her particular score upon successful completion of a shot by slapping the appropriate one of slap-pads 35 and 36 thereby advancing the score indicated on score indicators 33 and 34, respectively. In accordance with a further important aspect of the present invention, the game play controller (seen in FIG. 7) which is supported within housing 30 operates to preclude the advancing of the indicated score on score indicators 33 and 34 when slap-pad 35 or 36 is slapped by the user unless a successful shot has been previously sensed by score sensor 20.

FIG. 2 sets forth a rear perspective view showing the assembly of the backboard portion of the present invention basketball game. As described below, support frame 40 includes an angularly disposed main support 45 having an angled facet 46 defined in the upper portion thereof. A junction member 100 includes a cylindrical collar 53 defining a notch 54 therein and a pair of downwardly extending sockets 65 and 66. Collar 53 receives main support 45 while a pair of downwardly extending sockets 65 and 66 receive the upper end portions of support members 41 and 42. Main support 45 further includes a plurality of height adjusting apertures 48 arranged in a linear arrangement and aligned with notch 54 in collar 53. A removable key 105 is receivable within a selected one of apertures 48 and notch 54 of collar 53 to provide a selective height adjusting attachment.

Backboard 11 includes an attachment plate 70 which receives and is securable to angled facet 46. A control unit housing 30 is received and supported by backboard 11 together with a pair of indicator housings 31 and 32 in the manner described below in FIG. 5. Indicator housings 31 and 32 support a pair of depressible slap-pads 35 and 36, respectively. A plurality of electrical connection wires 23 and 24 couple the control unit within housing 30 to slap-pads 35 and 36 as well as score indicators 33 and 34, respectively.

Figure 3:
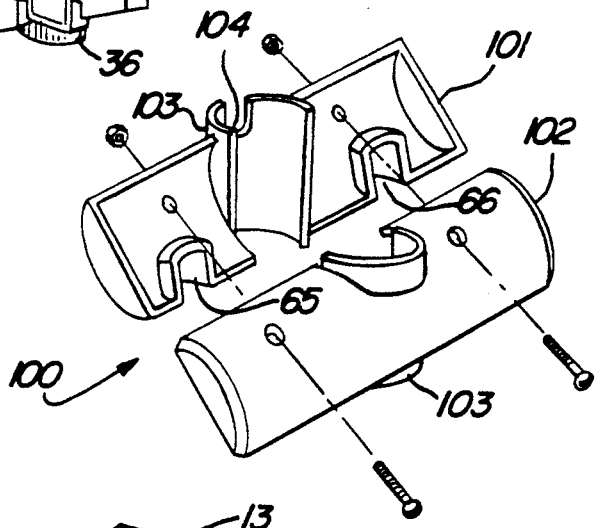
FIG. 3 sets forth an assembly view of a portion of the present invention basketball support structure.

FIG. 3 sets forth an assembly view of junction member 100 which is formed by a pair of complementary half portions 101 and 102. Half portions 101 and 102 combine to form junction 100 having cylindrical collar 103 and downwardly facing sockets 65 and 66 formed therein. Collar 103 further defines notch 104 which, as described above, receives key 105 to provide a locking height adjustment for main support 45 (seen in FIG. 2).

Figure 4:
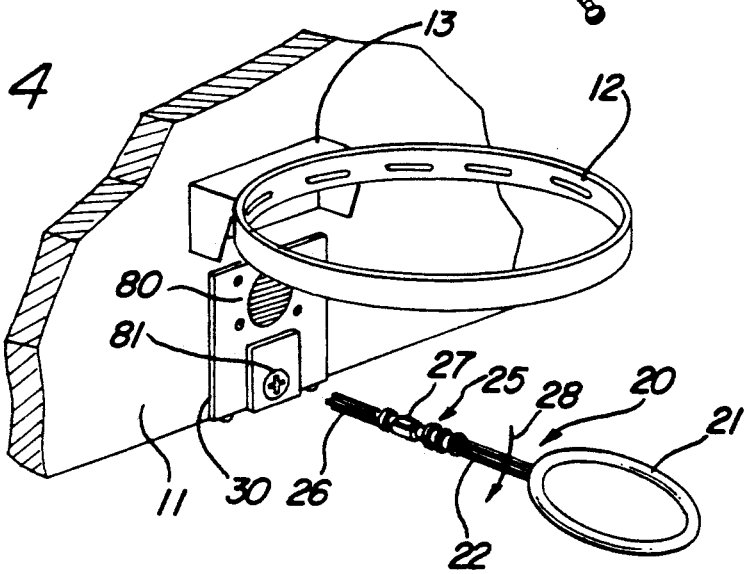
FIG. 4 sets forth a partially sectioned front perspective view of a portion of the present invention basketball.

FIG. 4 sets forth a partially sectioned perspective assembly view of the backboard and hoop portion of basketball game 10. As described above, backboard 11 receives and supports hoop support 13 and hoop 12 in the manner described below in FIG. 5. Backboard 11 also receives housing 30 which defines a speaker grill 80 and a cruciform shaped receptacle 81. A score sensor 20 includes an elongated shaft 22 coupled to a cruciform shaped end shaft 26 by a flexible joint 25. Flexible joint 25 includes a strain gauge or flex sensor 27. Shaft 22 further includes a generally circular ring 21.

Score sensor 20 is secured to housing 30 by insertion of cruciform shaped end portion 26 into receptacle 81. By means not shown, but in accordance with conventional fabrication techniques, strain gauge 27 is electrically coupled to the controller unit within housing 30 (seen in FIG. 7) as cruciform shaped end portion 26 is received within receptacle 81. Score sensor 20 functions in response to the passage of ball 16 through hoop 12 due to the deflection of ring 21 and shaft 22 caused by the heavy ball passing through hoop 12 and downwardly therefrom. As ball 16 (seen in FIG. 1) deflects flexible joint 25 in the direction indicated by arrow 28, flex sensor 27 responds to the flexing of joint 25 to produce an electrical change which is communicated to controller 120 (seen in FIG. 7) to provide a signal condition indicating a successful shot and score. The resilience of flexible joint 25 returns shaft 22 and ring 21 to the straight-line extended position shown in FIG. 4 once ball 16 has passed through net 14 (seen in FIG. 1).

FIG. 5 sets forth a perspective assembly view of backboard 11 and the associated components thereof. Backboard 11 defines a generally planar member having a rectangular center notch 92 and a pair of rectangular cross section apertures 93 and 94 equally spaced on either side of notch 92. Backboard 11 further defines a pair of multiply faceted notches 90 and 91 evenly spaced from notch 92.

A rectangular hoop support 13 is secured to hoop 12 and defines a pair of rearwardly extending post members 95 and 96. Posts 95 and 96 are received within apertures 93 and 94, respectively, of backboard 11 and provide attachment for hoop support 13 against backboard 11. In the preferred fabrication, posts 95 and 96 are expanded or spun over to provide an expanded diameter portion on the back side of backboard 11 which maintains posts 95 and 96 securely within apertures 93 and 94. A plurality of net attachments 15 extend inwardly about the inner surface of hoop 12 and receive and support a conventional basketball net 14.

In accordance with the present invention, housing 30 is received within notch 92 and supported upon backboard 11 using conventional fabrication techniques (not shown). Similarly, indicator housings 31 and 32 are received within notches 90 and 92, respectively, and secured using conventional attachment techniques (not shown). A plurality of connecting wires 23 and 24 provide electrical connection between housing 30 and indicator housings 31 and 32. Housings 31 and 32 support a pair of depressible slap-pads 35 and 36 together with a pair of digital score indicators 33 and 34, respectively. While not seen in FIG. 5, once the above-described assembly is complete, score sensor 20 is received within cruciform shaped receptacle 81 of housing 30 and extends into the center passage of net 14 in the manner shown in FIG. 1.

FIG. 6 sets forth a perspective assembly view of joint 52. It should be noted with temporary reference to FIG. 1 that joint 52 is typical of the plurality of joints 51–56 used to assemble support frame 40 from the various base elements and support members which form the support frame. Thus, the descriptions which accompany FIG. 6 in connection with joint 52 should be understood to be generally applicable to the remaining joints used to form support frame 40. Accordingly, joint 52 defines a pair of intersecting generally cylindrical elements having a plurality of outwardly extending cylindrical stubs 110, 116 and 118. Stub 110 defines an aperture 111 while stubs 116 and 118 define apertures 117 and 119, respectively. Support member 41 defines an interior cylindrical recess 115 and is assembled to joint 52 by coupling support member 41 to joint 52 such that cylindrical stub 110 is received within recess 115. Support member 41 further defines an aperture 112 aligned with aperture 111 of stub 110 when support member 41 is properly coupled to joint 52. A conventional fastener 114 is passed through aperture 112 and threadably received within and secured to aperture 111 of stub 110. Thus, support member 41 is securely attached to joint 52.

FIG. 6 also shows support member 37 assembled to joint 52 in the above-described manner. Thus, each support member and base element is secured to the appropriate one of joints 51–56 using the above-described attachment operation.

Figure 7:
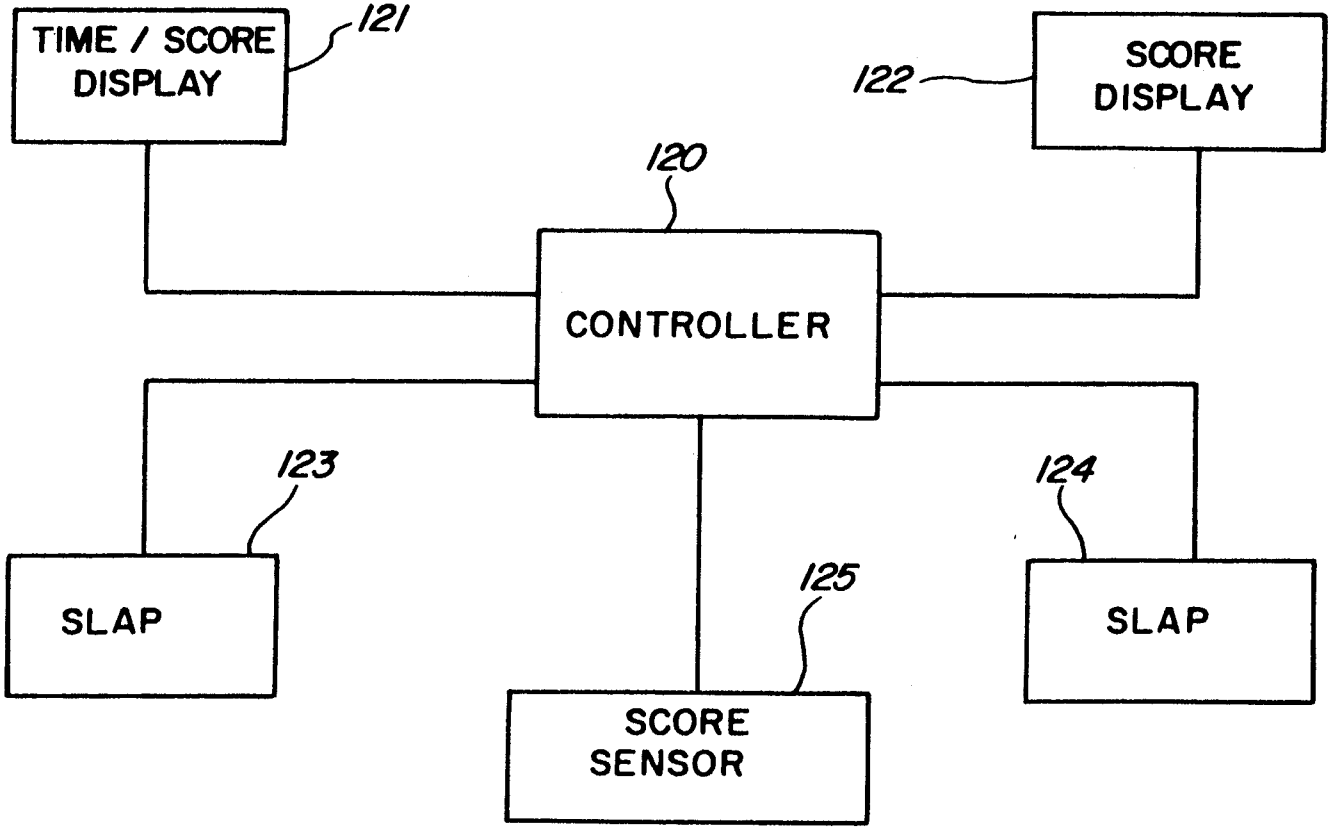
FIG. 7 sets forth a block diagram of the scoring portion of the present invention basketball game.

FIG. 7 sets forth a block diagram of the scorekeeping circuit of the present invention. A controller 120 is coupled to a pair of score display units 121 and 122. Controller 120 is in addition coupled to a pair if depressible slap-pad switches 122 and 124 as well as a score sensor input 125. In its preferred form, controller 120 includes a conventional microprocessor having a stored instruction set therein which defines a predetermined game pattern. Controller 120 receives input signals from slap-pads 123 and 124 as well as score sensor 125. Controller 120 provides output display drive signals which are coupled to score display elements 121 and 122.

As described above, and in accordance with an important aspect of the present invention, controller 120 responds to input signals from score sensor 125 as well as slap-pads 123 and 124 to increment the displayed score number upon score displays 121 and 122. Score sensor 125 provides an input signal each time a player successfully shoots and manages to move ball 16 through hoop 12 and net 14 (seen in FIG. 1). The above-described flexing of score sensor 20 (seen in FIG. 1) which occurs as ball 16 falls through net 14 produces the appropriate score signal which is coupled from score sensor 125 to controller 120.

In accordance with the preferred mode of game play operation, controller 120 increments the indicated score on score displays 121 and 122 in response to the appropriate activation of either of slap-pads 123 or 124 following a score indicating signal from score sensor 125. Thus, in the anticipated play pattern, a player having successfully scored a basket then increments the appropriate score change by slapping the particular slap-pad associated with that player. In accordance with the preferred operation of the present invention, controller 120 is unresponsive to either of slap-pads 123 or 124 in the absence of a preceding input signal from score sensor 125. Thus, players simply slapping the slap-pads do not increment the indicated score in the absence of a successful basket.

What has been shown is a basketball game having scoring slap-pads which permits each player to properly increment the players accumulated score following a successful shot in a slap action maneuver. The score indicating controller responds solely to the appropriate slap-pad actuation following a successful basket having been shot. In the absence of a successful basket, the controller generally ignores the slap-pad inputs.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

We claim:

1. A basketball game for use in combination with a ball comprising:

a generally planar backboard;

a generally circular hoop supported by said backboard;

a pair of player score indicators;

a pair of slap-pads each having a touch responsive pad supported by said backboard;

a score sensor proximate said hoop having means responsive to the passage of said ball through said hoop to produce a sensed basket signal in response to said ball passage; and control means for controlling said pair of player score indicators, said control means being coupled to said score sensor, said pair of slap-pads, and said pair of score indicators increasing the displayed score on a score indicator in response to the actuation of the appropriate one of said slap-pads in response to a sensed basket signal.

2. A basketball game as set forth in claim 1 wherein said backboard defines a lower edge and wherein said slap-pads extend at least partially below said lower edge.

3. A basketball game as set forth in claim 2 wherein said slap-pads are disposed on opposite sides of said hoop.

4. A basketball game as set forth in claim 3 wherein said score indicators, each include a digital score number display.

5. A basketball game as set forth in claim 4 having a support frame for supporting said backboard spaced above a play surface.

6. A basketball game as set forth in claim 5 wherein said support frame includes means for adjusting the spaced height of said backboard above said play surface.

7. A basketball game as set forth in claim 6 wherein said score sensor includes an elongated shaft having a flexible joint therein.

8. A basketball game as set forth in claim 7 wherein said score sensor includes a strain gauge operatively coupled to said flexible joint.

* * * * *